US008458999B2

(12) United States Patent
Dilo

(10) Patent No.: US 8,458,999 B2
(45) Date of Patent: Jun. 11, 2013

(54) FLEECE LAYER

(75) Inventor: Johann Phillipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 13/353,679

(22) Filed: Jan. 19, 2012

(65) Prior Publication Data

US 2012/0180265 A1 Jul. 19, 2012

(30) Foreign Application Priority Data

Jan. 19, 2011 (EP) ..... 11151390

(51) Int. Cl.
*D01G 25/00* (2006.01)

(52) U.S. Cl.
USPC ..... 57/296

(58) Field of Classification Search
USPC ..... 19/161.1, 163, 296, 302
See application file for complete search history.

(56) References Cited

U.S. PATENT DOCUMENTS

| | | | | |
|---|---|---|---|---|
| 3,877,628 | A * | 4/1975 | Asselin et al. | 226/113 |
| 6,085,391 | A * | 7/2000 | Schaffler | 19/163 |
| 6,195,844 | B1 | 3/2001 | Jourde et al. | |
| 7,690,086 | B2 * | 4/2010 | Dilo | 19/163 |
| 7,779,513 | B2 * | 8/2010 | Dilo | 19/163 |
| 7,810,218 | B2 * | 10/2010 | Dilo et al. | 19/163 |
| 2005/0193525 | A1 | 9/2005 | Leger | |
| 2005/0217077 | A1 * | 10/2005 | Bastian et al. | 19/161.1 |
| 2007/0175000 | A1 * | 8/2007 | Dilo et al. | 19/163 |
| 2008/0196207 | A1 * | 8/2008 | Dilo et al. | 19/163 |

FOREIGN PATENT DOCUMENTS

| | | | |
|---|---|---|---|
| EP | 1136600 | A1 | 9/2001 |
| WO | WO9405836 | A1 | 3/1994 |
| WO | WO02094697 | A1 | 11/2002 |
| WO | WO2010073221 | A2 | 7/2010 |

* cited by examiner

*Primary Examiner* — Shaun R Hurley
(74) *Attorney, Agent, or Firm* — Jansson Munger McKinley & Shape Ltd.

(57) ABSTRACT

The fleece layer for laying down a card web to form a fleece has a cross-lapping upper carriage, through which the card web is guided; a cross-lapping laying carriage, through which the card web coming from the upper carriage is guided and which serves to lay the card web down onto an output conveyor belt, and at least two card web conveyor belts for guiding the card web to the upper carriage and from there to the laying carriage. An upper run of a first endless card web conveyor belt extends from the infeed area of the fleece layer to the upper carriage and serves as a support surface for the card web. A positionally variable pressing means is provided, which can be actuated to produce a variable card web buffer in the upper run of the first card web conveyor belt.

14 Claims, 4 Drawing Sheets

FLEECE LAYER

CROSS REFERENCE TO RELATED APPLICATION

This application claims priority based on European patent application EP 11 151 390.9, filed Jan. 19, 2011.

FIELD OF THE INVENTION

The present invention relates to a fleece layer for laying down a card web to form a fleece.

BACKGROUND OF THE INVENTION

Fleece layers are used to lay multiple layers of a card web, produced by a carding machine, as uniformly as possible on an output apron. The card web is usually guided first through an upper carriage and proceeds from there to a laying carriage, through the laying gap of which the card web is deposited onto the output apron. At least two card web conveyor belts are used to guide the card web through the fleece layer. The movements of the card web conveyor belts, of the upper carriage, and of the laying carriage are controlled so as to coordinate with each other.

Fleece layers are often preceded by mechanisms for changing the web line speed. These are used primarily to regulate the density of the card web as a way of profiling the laid fleece or to compensate for increased thickness at the edges of the laid fleece. Mechanisms of this type for changing the line speed include, for example, take-off rolls, driven at different speeds, on the carding machine located upstream of the fleece layer, as known from U.S. Pat. No. 6,195,844, for example, or a separate web drafter, which can be installed between the carding machine and the fleece layer (see, for example, EP 1 532 302 A1).

In both of the patent documents cited above, fluctuations in the line speeds of the incoming web are compensated in the fleece layer by an integrated buffer, which is obtained by increasing the distance traveled by the upper carriage, which results in turn in an increase in the length of the loop in the first card web conveyor belt. For this purpose, a complex control system is required for the upper carriage, so that the buffer loop can be formed and the changes in the speed of the incoming card web can be compensated with precision at every moment of the laying process.

SUMMARY OF THE INVENTION

Fleece layers are used to lay multiple layers of a card web, produced by a carding machine, as uniformly as possible on an output apron. The card web is usually guided first through an upper carriage and proceeds from there to a laying carriage, through the laying gap of which the card web is deposited onto the output apron or output conveyor belt. At least two card web conveyor belts are used to guide the card web through the fleece layer. The movements of the card web conveyor belts, of the upper carriage, and of the laying carriage are controlled so as to coordinate with each other.

Fleece layers are often preceded by mechanisms for changing the web line speed. These are used primarily to regulate the density of the card web as a way of profiling the laid fleece or to compensate for increased thickness at the edges of the laid fleece. Mechanisms of this type for changing the line speed include, for example, take-off rolls, driven at different speeds, on the carding machine located upstream of the fleece layer, as known from U.S. Pat. No. 6,195,844, for example, or a separate web drafter, which can be installed between the carding machine and the fleece layer (see, for example, EP 1 532 302 A1).

In both of the patent documents cited above, fluctuations in the line speeds of the incoming web are compensated in the fleece layer by an integrated buffer, which is obtained by increasing the distance traveled by the upper carriage, which results in turn in an increase in the length of the loop in the first card web conveyor belt. For this purpose, a complex control system is required for the upper carriage, so that the buffer loop can be formed and the changes in the speed of the incoming card web can be compensated with precision at every moment of the laying process.

According to an aspect of the invention, a fleece layer for laying down a card web to form a fleece includes an upper carriage, which is movable back and forth in transverse directions and through which the card web is guided. A laying carriage, which is movable back and forth in the transverse directions and through which the card web coming from the upper carriage is guided, serves to lay the card web down onto an output conveyor belt. The fleece layer includes at least two card web conveyor belts for guiding the card web to the upper carriage and from there to the laying carriage. An upper run of a first endless card web conveyor belt extends from an infeed area of the fleece layer to the upper carriage and serves as a support surface for the card web. A positionally variable pressing member is included which is actuatable to produce a variable card web buffer in the upper run of the first card web conveyor belt.

The pressing member may be a pressing roll. The pressing roll may be movable in a vertical direction or in such a way that it presses down from above onto the cover belt and thus also onto the upper run of the first card web conveyor belt. The pressing roll may press down on a slanted infeed section of the cover belt and of the first card web conveyor belt. The fleece layer may include a smooth cover belt which is arranged between the upper run of the first card web conveyor belt and the pressing roll. The first card web conveyor belt may be rough.

The fleece layer may include two deflecting rolls of the first card web conveyor belt form lateral boundaries of the card web buffer and serve as tensioning aids during a time that the card web buffer is formed by the pressing roll.

The pressing member may a paddle and may be a paddle that includes a smooth surface. The paddle may be movable at a slant. The fleece layer may include a first card web conveyor belt that passes around at least a part of the paddle the time that the variable card web buffer is formed. The first card web conveyor belt may pass along a first lateral surface of the paddle, then over a blunt, relatively wide tip of the paddle, and finally along a second lateral surface of the paddle. The fleece layer may include two deflecting rolls of the first card web conveyor belt that form lateral boundaries of the card web buffer and serve as tensioning aids during a time that the card web buffer is formed by the paddle.

The fleece layer may also include a movable tension carriage through which the first card web conveyor belt passes. The tension carriage may be movable and the of the tension carriage may be controllable in an open-loop or closed-loop fashion to compensate for an additional length of the first card web conveyor belt required for the card web buffer.

BRIEF DESCRIPTION OF THE DRAWINGS

Additional features and advantages of the present invention can be derived from the following description, which refers to the drawings.

DETAILED DESCRIPTION OF THE INVENTION

Figure 1:
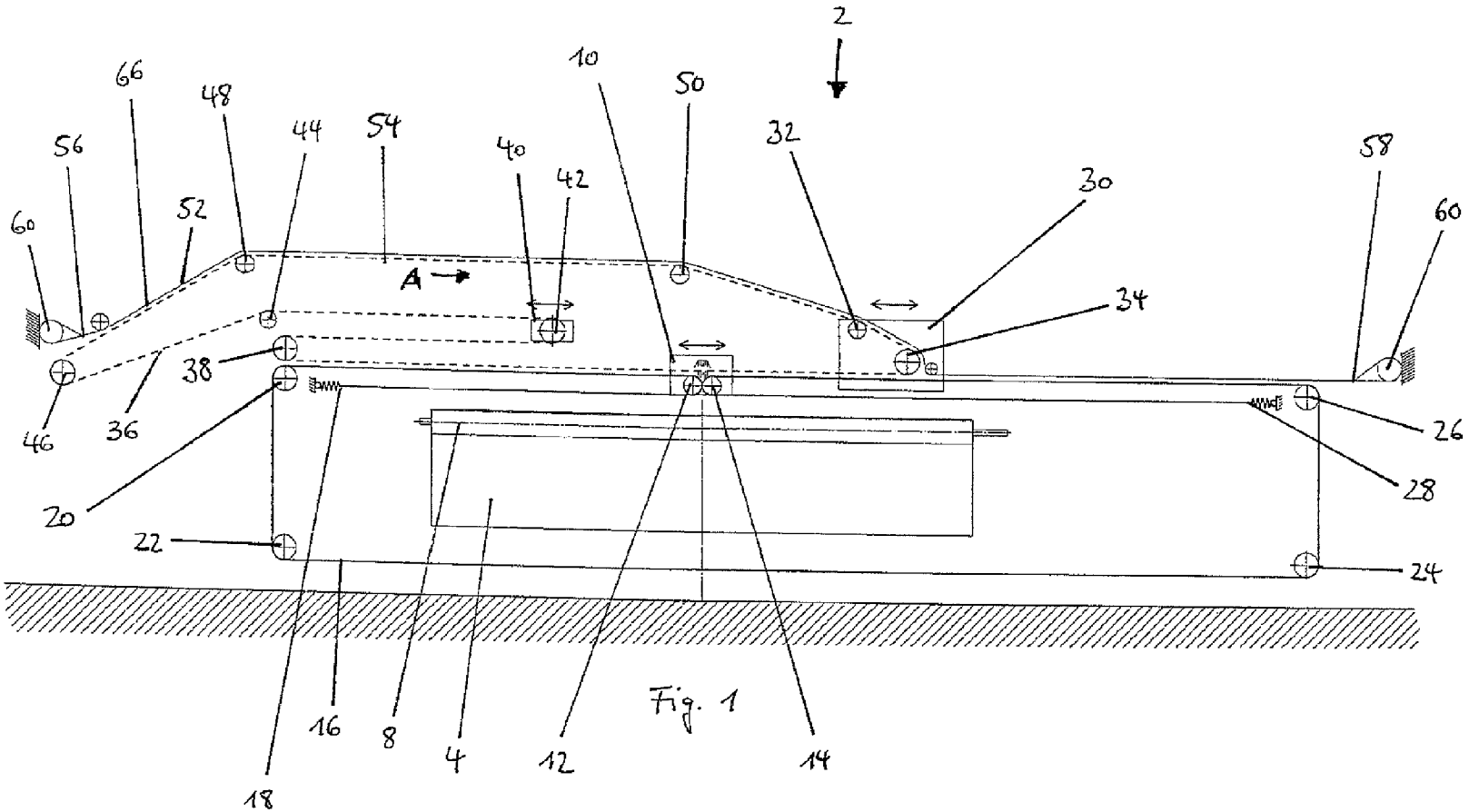
FIG. 1 is a schematic, cross-sectional view of one preferred embodiment of a fleece layer in which the invention can be applied.
Figure 2:
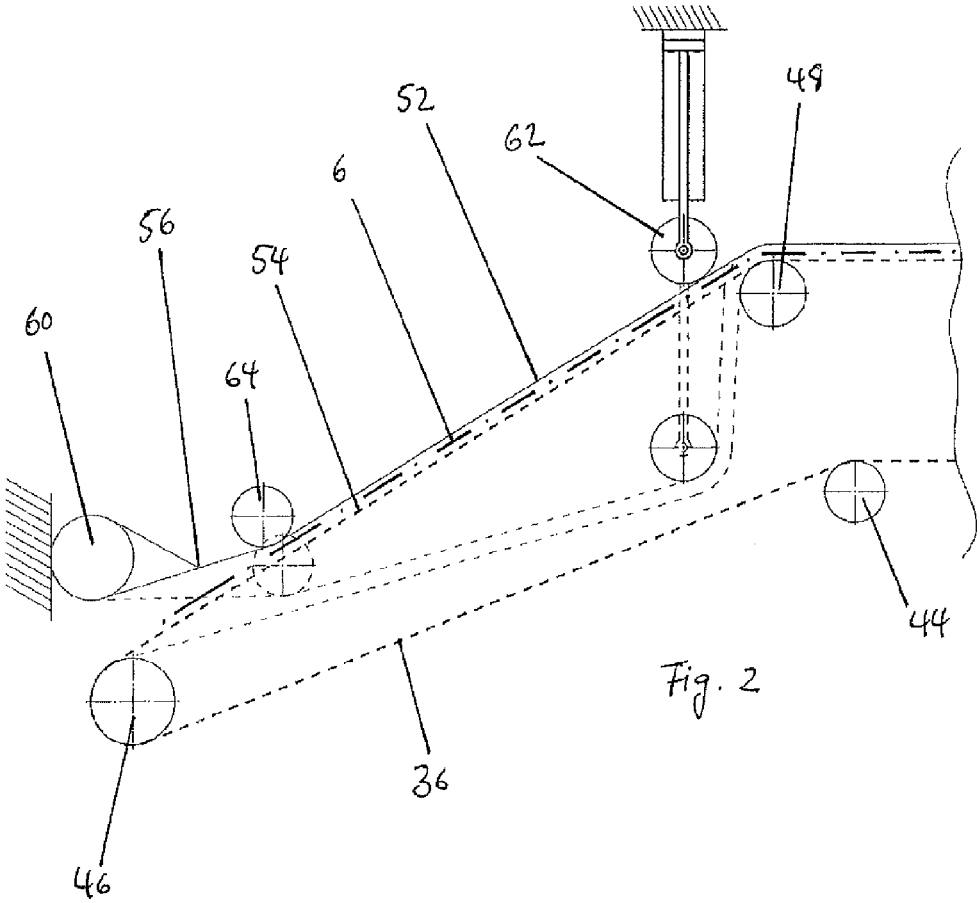
FIG. 2 is a schematic cross-sectional view of a preferred way of forming the card web buffer according to the invention in the infeed area of the fleece layer.

FIG. 1 is a schematic cross-sectional view of a fleece layer 2 in which the present invention can be applied. In FIG. 1 fleece layer 2 with its endless output conveyor belt 4 (apron) is shown, which is intended to carry away the fleece produced from a card web 6 (see FIG. 2) in a transport direction perpendicular to the plane of the drawing. An upper deflecting roll 8, which represents one of the guide devices of output conveyor belt 4, is shown. For the sake of clarity, card web 6 is shown only in FIG. 2.

A laying carriage 10 can be moved back and forth on rails or pipes (not shown) above output conveyor belt 4. Two freely rotatable deflecting rolls 12 and 14 are supported in laying carriage 10. A card web conveyor belt 16, also called the "second card web conveyor belt 16" below, wraps part of the way around first deflecting roll 12. At its first end 18, second card web conveyor belt 16 is permanently connected to the machine stand (not shown) of fleece layer 2 and extends from there above and only a short distance away from output conveyor belt 4 until it reaches laying carriage 10, where it reverses direction by 180° and is then guided back over four stationary deflecting rolls 20, 22, 24, 26 before arriving back at second deflecting roll 14 in the laying carriage. Second card web conveyor belt 16 wraps part of the way around deflecting roll 14, which is also supported in freely rotatable fashion in laying carriage 10. Card web conveyor belt 16 thus reverses its direction here by 180° and then proceeds from the lower outlet area of laying carriage 10, passing only a short distance above output conveyor belt 4, to the machine stand of fleece layer 2, to which its second end 28 is also permanently attached.

On laying carriage 10, a chain or a toothed belt is mounted, which passes, for example, over a drive gear wheel connected to a motor and a deflecting roll (none of these elements is shown). By means of these drive devices, laying carriage 10 can be moved back and forth above output conveyor belt 4 crosswise to the transport direction of the belt (i.e., in transverse directions).

At about the same height as laying carriage 10, an upper carriage 30 is supported on rails or pipes (not shown) in the machine stand of fleece layer 2 so that it can move crosswise to the transport direction of output conveyor belt 4 (i.e., in transverse directions). The rails or pipes can be the same rails or pipes as those on which laying carriage 10 is also movably supported. Upper carriage 30 has an upper deflecting roll 32 and a lower deflecting roll 34, which are offset laterally from each other. Another card web conveyor belt 36, called the "first card web conveyor belt 36", passes over these two deflecting rolls 32, 34. In the area bounded by two deflecting rolls 32, 34 in the upper carriage, first card web conveyor belt 36 passes downwards at a slant.

Proceeding from lower deflecting roll 34 in upper carriage 30, first card web conveyor belt 36 extends parallel to the right upper run of second card web conveyor belt 16. First card web conveyor belt 36 extends in a straight line through laying carriage 10, and, after leaving laying carriage 10, it passes over a stationary, motor-driven deflecting roll 38. From there, it is guided over a deflecting roll 42 supported in a tension carriage 40 and then proceeds over several stationary deflecting rolls 44, 46, 48, 50 supported in the machine stand of fleece layer 2 before reaching upper carriage 30 again. Upper carriage 30 and tension carriage 40 can be connected to each other by a chain or a toothed belt (not shown), which passes over a drive gear wheel connected to a motor (not shown) and a deflecting pulley, which are mounted in the machine stand. Tension carriage 40 is also supported on rails or pipes (not shown), so that it can move back and forth. It can also be advantageous for the movements of the upper carriage and those of tension carriage 40 to be isolated from each other.

In the area between lower deflecting roll 34 of upper carriage 30 and second deflecting roll 14 of laying carriage 10, sections of first card web conveyor belt 36 and of second card web conveyor belt 16 are guided parallel to and only a short distance away from each other, so that card web 6 supplied by first card web conveyor belt 36 is sandwiched between first card web conveyor belt 36 and second card web conveyor belt 16 in the just-mentioned area between upper carriage 30 and laying carriage 10. Card web 6 is supported on second card web conveyor belt 16. In addition, the two sections of second card web conveyor belt 16 extending between laying carriage 10 and the machine stand of fleece layer 2 simultaneously serve as a cover belt for the deposited fleece.

It can be seen in FIG. 1 that upper carriage 30 and its associated tension carriage 40 move in opposite directions during operation. Tension carriage 40 serves to keep the length of the loop of first card web conveyor belt 36 constant.

The movements of laying carriage 10 and of upper carriage 30 are coordinated with each other in such a way that, as card web 6 is being supplied at uniform speed to fleece layer 2, card web 6 can be deposited in a controlled manner on output conveyor belt 4 without any stretching or squeezing within fleece layer 2. Upper carriage 30 travels in the same direction as laying carriage 10 but on average only half as fast. Account is also taken of the fact that laying carriage 10 is braked to a stop in the area where it reverses direction and then must be accelerated again.

A gap, called the laying gap, is formed between two deflecting rolls 12 and 14 in laying carriage 10. During the operation of fleece layer 2, two card web conveyor belts 16, 36 are driven in such a way that they travel at the same speed.

If card web 6 is supplied at fluctuating speeds, perhaps because a web drafter (not shown) working in cycles is installed upstream of fleece layer 2 so that alternating thicknesses can be produced in card web 6 for the purpose of achieving a transverse profiling of the laid fleece, a variable card web buffer can be used in fleece layer 2 to buffer the card web within fleece layer 2.

According to the invention, this variable card web buffer is formed in the infeed area of fleece layer 2 and thus requires no change in actuation of upper carriage 30 or of laying carriage 10.

In a first preferred embodiment of the variable card web buffer, fleece layer 2 comprises a cover belt 52, which extends from the infeed area of fleece layer 2 at least as far as upper carriage 30. Cover belt 52 lies directly above the upper run 54 of first card web conveyor belt 36, which serves in this area as a support surface for card web 6 and which moves in the direction of the arrow A. Card web 6 is thus enclosed between upper run 54 of first card web conveyor belt 36 and cover belt 52. Whereas first card web conveyor belt 36 has a rough surface and is preferably designed as an air-permeable screen belt, cover belt 52 has a smooth surface and is substantially stationary in fleece layer 2. Cover belt 52 is preferably impermeable to air and made out of, for example, Teflon-coated or PVC-coated fabric. It is also possible for first card web conveyor belt 36 to be impermeable to air, whereas stationary cover belt 52 has pores to allow air to escape but is not rough. It is also conceivable for many applications for both cover belt 52 and first card web conveyor belt 36 to be impermeable to air.

The endless first card web conveyor belt 36 carries card web 6 lying on it forward by friction, and cover belt 52, which does not move along with card web 6, serves as a stationary cover and thus prevents the fibers of card web 6 from being whirled up or blown away in an undesirable manner. Card web 6 thus remains free of turbulence for the most part, which allows higher web line speeds to be achieved. In other words, card web 6 is guided in a sandwich-like manner between upper run 54 of first card web conveyor belt 36 and cover belt 52, wherein it is moved forward exclusively by the movement of first card web conveyor belt 36. The smooth cover belt 52 offers no obstacle to the movement of card web 6.

Cover belt 52 does not necessarily have to cover entire upper run 54 of first card web conveyor belt 36, but it preferably extends from the infeed area of fleece layer 2 all the way through upper carriage 30. Stationary cover belt 52 is preferably attached at both ends to the machine stand of fleece layer 2. Cover belt 52 will thus proceed from a first attachment point 56 in the infeed area of fleece layer 2, follow the path of first card web conveyor belt 36 all the way to upper carriage 30, pass through the carriage, and then proceed from upper carriage 30 horizontally to the second attachment point 58 at the rear of fleece layer 2. In the area of the attachment points 56, 58, cover belt 52 is preferably supported in the machine stand by extendible support means 60. Extendible support means 60 can be either springs or pneumatic cylinders or other suitable elements.

To form the card web buffer, fleece layer 2 also comprises, in its infeed area, a pressing means, in the present case a vertically movable pressing roll 62. The position of pressing roll 62 can be adjusted, and it can preferably be moved in such a way that it presses down from above onto cover belt 52 and thus simultaneously onto upper run 54 of first card web conveyor belt 36. This movement can be assisted by a support roll 64, which is also arranged in the infeed area of fleece layer 2 and which also presses down from above onto cover belt 52. To ensure that the distance which card web 6 travels when pressing roll 62 is lowered is increased in a defined manner, deflecting roll 48, for example, can be used in conjunction with deflecting roll 46 as a tensioning means. The increased distance which card web 6 travels will then extend substantially vertically between lowered pressing roll 62 and deflecting roll 48, as can be seen from the diagram of loop formation shown in broken line in FIG. 2. In the especially preferred embodiment shown here, pressing roll 62 presses down on the slanted infeed section 66 of cover belt 52 and thus also of first card web conveyor belt 36.

To compensate for the additional length of cover belt 52 required in the card web buffer, the extendible support means 60 are provided, by means of which the mounting of cover belt 52 at its two ends can be extended. Because first card web conveyor belt 36 moves, the situation is different for it. To compensate for the additional length of first card web conveyor belt 36 required in the card web buffer, tension carriage 40, for example, can be actuated in a correspondingly different way. In the preferred embodiment shown here, tension carriage 40 (see FIG. 1) can, by moving toward the left, provide the additional length of first card web conveyor belt 36 required for the card web buffer while simultaneously leaving the overall length of first card web conveyor belt 36 unchanged. It is also possible to conceive of other methods of compensation operating within the closed loop of first card web conveyor belt 36.

This card web buffer makes it possible to compensate for the previously mentioned differences in the speed of incoming card web 6 without the need to make the movements of upper carriage 30 or of laying carriage 10 different from the movements executed during normal operation.

Figure 3:
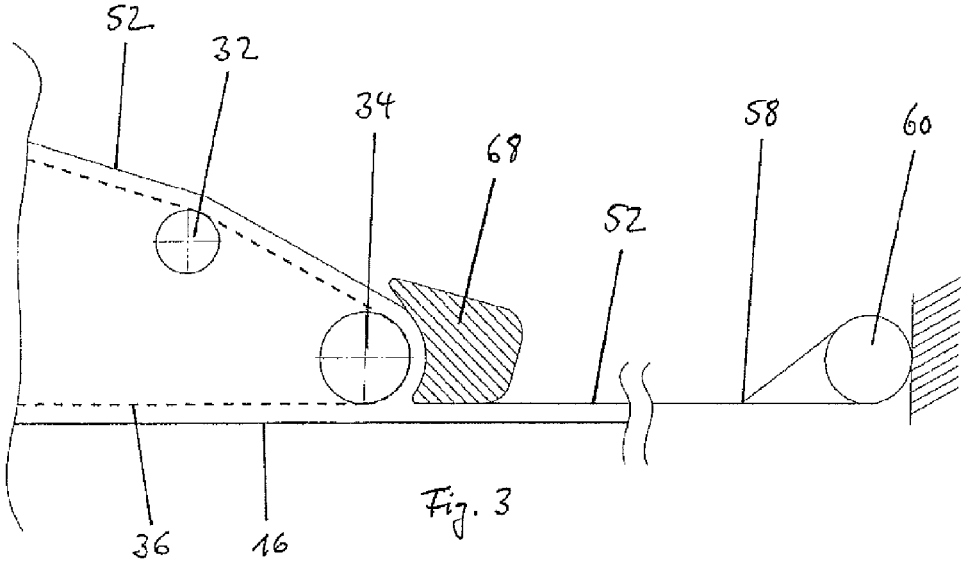
FIG. 3 is a schematic cross-sectional view of a preferred way of guiding the cover belt in the area of the upper carriage.

FIG. 3 shows one preferred embodiment of guiding cover belt 52 in upper carriage 30. Due to the back-and-forth travel of upper carriage 30, stationary cover belt 52 must be supported on both the left and right so that, when upper carriage 30 moves, cover belt 52 can slide through it in a defined manner. For this purpose, an additional guide element 68 is required. In the present example, this is a guide shoe, which must be as smooth as possible. It is located opposite and directly adjacent to lower deflecting roll 34 of upper carriage 30.

Figure 4:
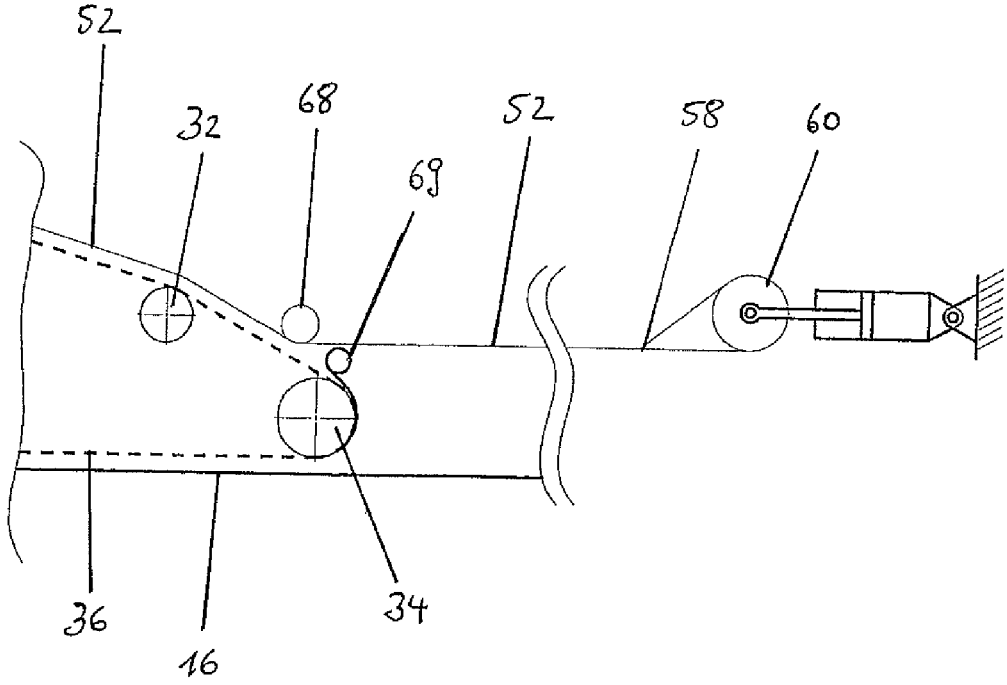
FIG. 4 is a schematic cross-sectional view of another preferred way of guiding the cover belt in the area of the upper carriage.

FIG. 4 shows an alternative preferred embodiment for guiding cover belt 52 in upper carriage 30. Here guide element 68 is designed as a smooth roll, which is carried along with upper carriage 30. This guide roll is arranged above lower deflecting roll 34, and cover belt 52 is deflected around it. In a case such as this, it is advantageous with respect to the guidance of card web 6 around lower deflecting roll 34 to provide an additional guide means 69, such as the guide means known from US 20080256756 A1.

Figure 5:
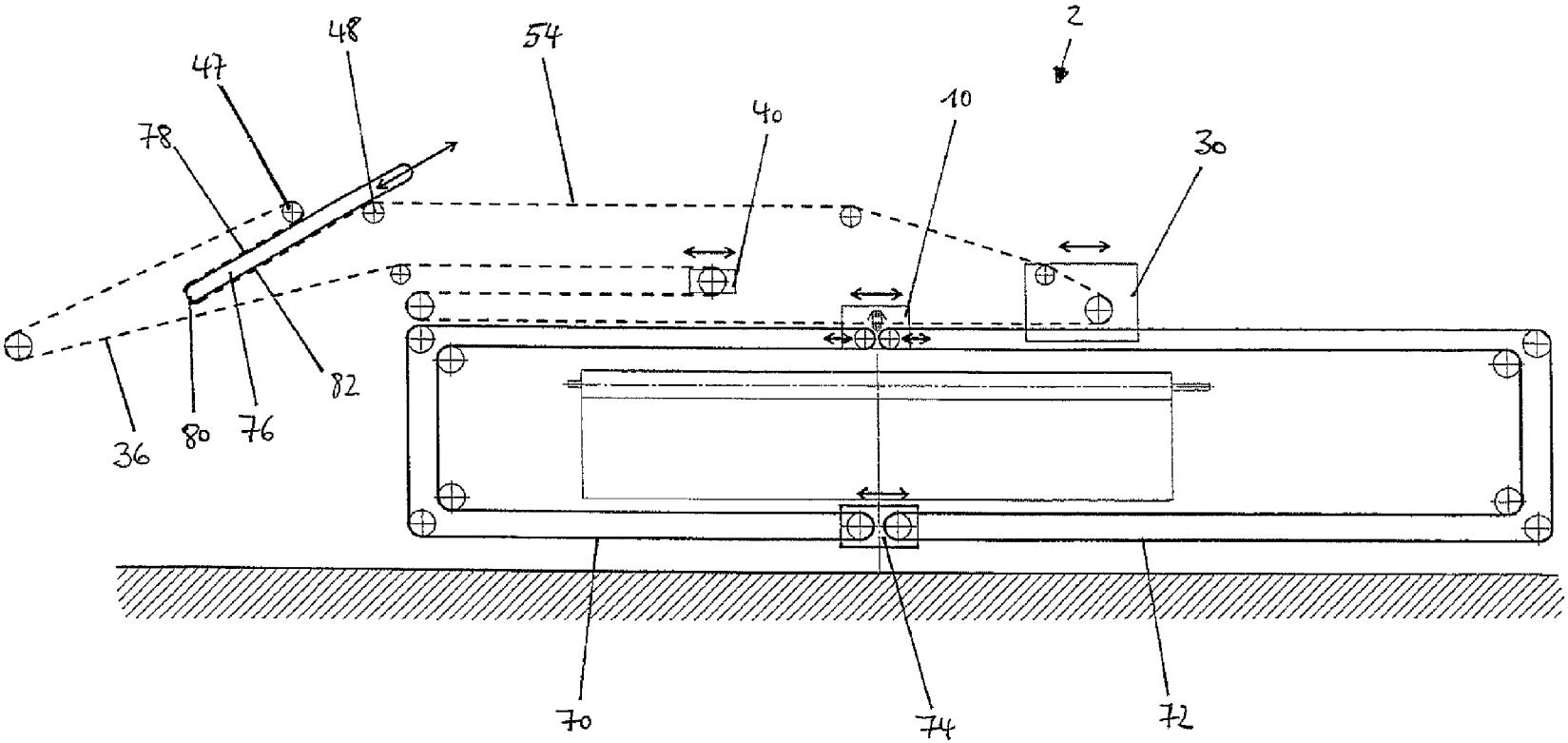
FIG. 5 is a schematic cross-sectional view of an alternative preferred embodiment of a fleece layer with a card web buffer according to the invention formed in an alternative manner.

As described above, fleece layer 2 contains a total of two card web conveyor belts 16, 36. The invention can also be applied to other types of fleece layers with two card web conveyor belts and also to all other types of fleece layers, including those with three belts. One preferred embodiment of such a fleece layer with three card web conveyor belts is shown in FIG. 5. In the case of the fleece layer shown in FIG. 5, second card web conveyor belt 16 of the embodiment according to FIG. 1 is replaced by a second card web conveyor belt 70 and a third card web conveyor belt 72, which are deflected inside a common tension carriage 74.

The invention is also applicable to opposite-motion fleece layers, in which upper carriage 30 and laying carriage 10 move in opposite directions, and also to camel-back fleece layers.

FIG. 5 also shows an alternative preferred embodiment of the pressing means and of the way in which the card web is buffered. In this embodiment, the positionally variable pressing means is designed as a movable paddle 76. Paddle 76 is preferably oriented at a slant and extends between two deflecting rolls 47 and 48 of first card web conveyor belt 36. Paddle 76 is preferably equipped with a smooth surface, so that the forward movement of card web 6 takes place exclusively by means of first rough card web conveyor belt 36, whereas card web 6 simply slides along the smooth paddle 76. Paddle 76 can be moved back and forth to adjust the size of the card web buffer. To adjust its position, any of the common drive means known to the person skilled in the art can be used. Paddle 76 can also comprise a driven, endless guide belt (not shown) in place of the smooth surface.

In the card web buffer which has been formed, upper run 54 of first card web conveyor belt 36 thus travels along a first lateral surface 78 of the paddle, whereupon it is guided over the tip 80 of paddle 76 and then along the second lateral surface 82 of paddle 76. The dimensions of paddle 76 will be selected as a function of the application purpose, but tip 80 of paddle 76 should be relatively blunt and wide to allow card web 6 to slide easily over tip 80. Tip 80 could resemble the shape of, for example, a semi-circle. In the exemplary embodiment shown here, first lateral surface 78 and second lateral surface 82 of paddle 76 are parallel to each other. Lateral surfaces 87, 82 of paddle 76 could also be curved, for example, and/or they could diverge from each other starting from tip 80 of paddle 76.

In addition to the variants of the pressing means discussed here, there are also other equivalent embodiments which can be imagined which the person skilled in the art can use to obtain a variable card web buffer for increasing the length of the distance which card web 6 travels in upper run 54 of first card web conveyor belt 36.

Reference throughout this specification to "one embodiment," "an embodiment," "a preferred embodiment," "alternate embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," "in an alternate embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain preferred, exemplary, alternate or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A fleece layer for laying down a card web to form a fleece, comprising:

an upper carriage, which is movable back and forth in transverse directions and through which the card web is guided;

a laying carriage, which is movable back and forth in the transverse directions and through which the card web coming from the upper carriage is guided, the laying carriage serving to lay the card web down onto an output conveyor belt;

at least two card web conveyor belts for guiding the card web to the upper carriage and from there to the laying carriage, wherein an upper run of a first endless card web conveyor belt extends from an infeed area of the fleece layer to the upper carriage and serves as a support surface for the card web; and a positionally variable pressing means, which is actuatable to produce a variable card web buffer in the upper run of the first card web conveyor belt.

2. The fleece layer of claim 1, wherein the pressing means is a pressing roll.

3. The fleece layer of claim 2, wherein the pressing roll is movable in a vertical direction.

4. The fleece layer of claim 2, wherein a smooth cover belt is arranged between the upper run of the first card web conveyor belt and the pressing roll, and wherein the first card web conveyor belt is rough.

5. The fleece layer of claim 4, wherein the pressing roll is movable in such a way that it presses down from above onto the cover belt and thus also onto the upper run of the first card web conveyor belt.

6. The fleece layer of claim 5, wherein the pressing roll presses down on a slanted infeed section of the cover belt and of the first card web conveyor belt.

7. The fleece layer of claim 2, wherein two deflecting rolls of the first card web conveyor belt form lateral boundaries of the card web buffer and serve as tensioning aids during a time that the card web buffer is formed by the pressing roll.

8. The fleece layer of claim 1, wherein the pressing means is a paddle.

9. The fleece layer of claim 8, wherein the paddle comprises a smooth surface, and wherein the first card web conveyor belt is rough.

10. The fleece layer of claim 8, wherein the paddle is movable at a slant.

11. The fleece layer of claim 8, wherein, during a time that the variable card web buffer is formed, the first card web conveyor belt passes around at least a part of the paddle.

12. The fleece layer of claim 11, wherein the first card web conveyor belt passes along a first lateral surface of the paddle, then over a blunt, relatively wide tip of the paddle, and finally along a second lateral surface of the paddle.

13. The fleece layer of claim 8, wherein two deflecting rolls of the first card web conveyor belt form lateral boundaries of the card web buffer and serve as tensioning aids during a time that the card web buffer is formed by the paddle.

14. The fleece layer of claim 1, wherein a movable tension carriage is provided, through which the first card web conveyor belt passes and the movement of which is controllable in an open-loop or closed-loop fashion to compensate for an additional length of the first card web conveyor belt required for the card web buffer.

* * * * *